US010717553B2

(12) United States Patent
Nishino et al.

(10) Patent No.: US 10,717,553 B2
(45) Date of Patent: Jul. 21, 2020

(54) FILLING SYSTEM

(71) Applicant: SHIBUYA CORPORATION, Ishikawa (JP)

(72) Inventors: Yukinobu Nishino, Ishikawa (JP); Katsunori Tanikawa, Ishikawa (JP); Koji Kaya, Ishikawa (JP); Kengo Ikeda, Ishikawa (JP); Shigeki Koishi, Ishikawa (JP); Masaaki Eda, Ishikawa (JP)

(73) Assignee: SHIBUYA CORPORATION, Ishikawa (JP)

( * ) Notice: Subject to any disclaimer, the term of this patent is extended or adjusted under 35 U.S.C. 154(b) by 0 days.

(21) Appl. No.: 16/333,077

(22) PCT Filed: Sep. 13, 2017

(86) PCT No.: PCT/JP2017/033154
§ 371 (c)(1),
(2) Date: Mar. 13, 2019

(87) PCT Pub. No.: WO2018/052049
PCT Pub. Date: Mar. 22, 2018

(65) Prior Publication Data

US 2019/0263544 A1 Aug. 29, 2019

(30) Foreign Application Priority Data

Sep. 14, 2016 (JP) ..... 2016-179715

(51) Int. Cl.
*B65B 3/04* (2006.01)
*B67C 3/22* (2006.01)
(Continued)

(52) U.S. Cl.
CPC ..... *B65B 3/04* (2013.01); *B65B 43/46* (2013.01); *B67C 3/00* (2013.01); *B67C 3/225* (2013.01);
(Continued)

(58) Field of Classification Search
CPC ..... B65B 3/04; B65B 43/46; B67C 7/0073; B67C 7/0006; B67C 3/00; B67C 3/24;
(Continued)

(56) References Cited

U.S. PATENT DOCUMENTS 3,018,184 A * 1/1962 Mck ..... B65B 55/10 426/399
3,566,575 A * 3/1971 Lisiecki ..... B65B 55/10 53/426
(Continued)

FOREIGN PATENT DOCUMENTS

EP 2 179 960 A1 4/2010
EP 2 361 874 A2 8/2011
(Continued)

OTHER PUBLICATIONS

International Search Report issued in PCT/JP2017/033154, dated Oct. 17, 2017.
(Continued)

*Primary Examiner* — Nicolas A Arnett
(74) *Attorney, Agent, or Firm* — Greenblum & Bernstein, P.L.C.

(57) ABSTRACT

A filling system includes a conveyance chamber in which a center wheel for conveying vessels is housed inside, a filling chamber where filling machines are housed inside, an inlet/outlet wheel that transfers the vessels from the center wheel to the filling machine, an opening that allows conveyance of the vessels, and a shutter that closes the opening. The inlet/outlet wheel includes grippers configured from a fixed
(Continued)

section and a movable section. The movable section can be raised or lowered with respect to the rotational axis of the inlet/outlet wheel. When the shutter closes the opening, movable section is raised or lowered by a predetermined amount relative to the fixed section, after which the movable section is rotated by a predetermined amount to a position where it does not interfere with the shutter.

1 Claim, 7 Drawing Sheets

(51) Int. Cl.

| | |
|---|---|
| ***B67C 3/24*** | (2006.01) |
| ***B67C 7/00*** | (2006.01) |
| ***B67C 3/00*** | (2006.01) |
| ***B65B 43/46*** | (2006.01) |
| *B67C 3/28* | (2006.01) |

(52) U.S. Cl.
CPC ..... *B67C 3/24* (2013.01); *B67C 7/0006* (2013.01); *B67C 7/0073* (2013.01); *B67C 3/001* (2013.01); *B67C 3/28* (2013.01); *B67C 2007/006* (2013.01)

(58) Field of Classification Search
CPC ..... B67C 3/225; B67C 3/001; B67C 3/28; B67C 2007/006
See application file for complete search history.

(56) References Cited

U.S. PATENT DOCUMENTS

| | | | | | |
|---|---|---|---|---|---|
| 3,911,640 | A * | 10/1975 | Rausing | A61L 2/10 | 53/426 |
| 4,014,158 | A * | 3/1977 | Rausing | B65B 55/025 | 53/167 |
| 4,056,921 | A * | 11/1977 | Gilliand | A61L 2/26 | 53/167 |
| 4,375,145 | A * | 3/1983 | Mosse | B65B 55/04 | 141/103 |
| 7,104,033 | B2 * | 9/2006 | Krulitsch | B67C 3/004 | 53/467 |
| 7,140,161 | B2 * | 11/2006 | Till | B67C 3/22 | 53/167 |
| 7,165,582 | B2 * | 1/2007 | Till | B67C 7/0086 | 141/144 |
| 7,200,975 | B2 * | 4/2007 | Till | B65G 47/846 | 198/441 |
| 7,739,859 | B2 * | 6/2010 | Colato | A61L 2/087 | 53/167 |
| 9,233,820 | B2 * | 1/2016 | Bernhard | B67B 3/2033 | |
| 9,617,135 | B2 * | 4/2017 | Hayakawa | B67C 3/242 | |
| 10,035,614 | B2 * | 7/2018 | van der Meijden | B65B 43/50 | |
| 2001/0010145 | A1 * | 8/2001 | Tawa | B65B 3/022 | 53/425 |
| 2005/0097863 | A1 * | 5/2005 | Taggart | B67C 7/0033 | 53/167 |
| 2010/0018168 | A1 * | 1/2010 | Bruijns | B67B 3/206 | 53/490 |
| 2010/0037984 | A1 * | 2/2010 | Hiroya | B67C 7/0073 | 141/59 |
| 2010/0037986 | A1 * | 2/2010 | Neumann | F16J 15/002 | 141/91 |
| 2011/0250307 | A1 | 10/2011 | Quetel et al. | | |
| 2012/0151873 | A1 * | 6/2012 | Niehr | B67C 7/0073 | 53/167 |
| 2019/0291910 | A1 * | 9/2019 | Geissler | B65B 43/50 | |

FOREIGN PATENT DOCUMENTS

| | | | |
|---|---|---|---|
| EP | 2 361 874 | A3 | 7/2013 |
| EP | 2 653 395 | A1 | 10/2013 |
| JP | 2003-237936 | A | 8/2003 |
| JP | 2012-126436 | A | 7/2012 |
| JP | 2014-213877 | A | 11/2014 |

OTHER PUBLICATIONS

Written Opinion issued in PCT/JP2017/033154, dated Oct. 17, 2017.
Extended European Search Report received in Counterpart Patent Appl. No. 17 850 950.1, dated Apr. 20, 2020.

* cited by examiner

FILLING SYSTEM

TECHNICAL FIELD

The present invention relates to a filling system having a plurality of filling machines which can perform cleaning work on an unused filling machine while performing a filling operation with other filling machines, and particularly, it relates to a filling system having a vessel transfer means that hands over vessels to the filling machine through an opening that can be opened and closed by a closure means.

BACKGROUND ART

For example, there is known a filling system including first and second filling machines; in the first operation mode, the first and the second filling machines fill different liquids into a vessel in turn; and in the second operation mode, only the second filling machine is used to fill only one type of liquid into the vessel while the unused first filling machine is washed (refer to Patent Document 1).

This filling system includes a bypass wheel for directly transporting a vessel to the second filling machine by skipping the first filling machine in the second operation mode. A rinser outlet wheel, which ejects vessels from a rinser provided upstream of the first filling machine and the bypass wheel, transfers vessels to a first conveyance wheel in the first operation mode and to the bypass wheel in the second operation mode.

Furthermore, in order to enable cleaning of the first filling machine in the second operation mode, a section provided with the first filling machine needs to be isolated from a section provided with the bypass wheel. Therefore, as for the structure disclosed in Patent Document 1, vessels are supplied to the first filling machine via the first conveyance wheel and a first inlet wheel, but are ejected from the first filling machine via a first outlet wheel and a second conveyance wheel. Further, a partition wall is provided between the first conveyance wheel and the first inlet wheel and between the first outlet wheel and the second conveyance wheel, whereby vessels are transferred through each of the opening provided with a shutter. Note that, when closing the opening of the partition wall with the shutter, the grippers of the first and second conveyance wheels are manually detached therefrom to avoid interference with the shutter.

PRIOR ART DOCUMENT

Patent Document

Patent Document 1:

Japanese Unexamined Patent Publication No. 2014-213877

SUMMARY OF THE INVENTION

Problem to be Solved by the Invention

However, with a configuration disclosed in Patent Document 1, when closing the opening of the partition wall with the shutter, a manual gripper-detaching process is required that makes the operation cumbersome, and as a result, the time required for the cleaning operation becomes problematic.

An object of the present invention is to provide a filling system that can clean an inactive filling machine while performing a filling operation with another (other) filling machine(s), and improve the efficiency of the cleaning operation for the filling machine by automatically moving the grippers to a position that does not interfere with the shutter.

Means for Solving the Problems

The filling system of the present invention comprises a conveyance chamber in which an aseptic condition is maintained and in which a conveyance means for conveying vessels is housed inside, a filling chamber that is connected to the conveyance chamber and where a rotary-type filling machine that comprises a plurality of filling means is housed inside, a rotary-type vessel transfer means that hands over the vessels from the conveyance means to the filling machine, an opening that is provided between the two chambers and that allows conveyance of the vessels via the vessel transfer means, and an opening/closing means for closing the opening; wherein the vessel transfer means comprises a vessel holding means that can retain the vessels, a part of the vessel holding means can be raised and lowered with respect to a rotational axis of the vessel transfer means, and when the opening/closing means closes the opening, a part of the vessel holding means is raised or lowered by a predetermined amount relative to the other vessel holding means, after which the vessel transfer means is rotated by a predetermined amount to a position where it does not interfere with the opening/closing means.

Effect of the Invention

According to the present invention, a filling system is provided that can clean an inactive filling machine while performing a filling operation with another (other) filling machine(s) and improve the efficiency of the cleaning operation for the filling machine by automatically moving the grippers to a position that does not interfere with the shutter.

EMBODIMENT OF THE INVENTION

Figure 1:
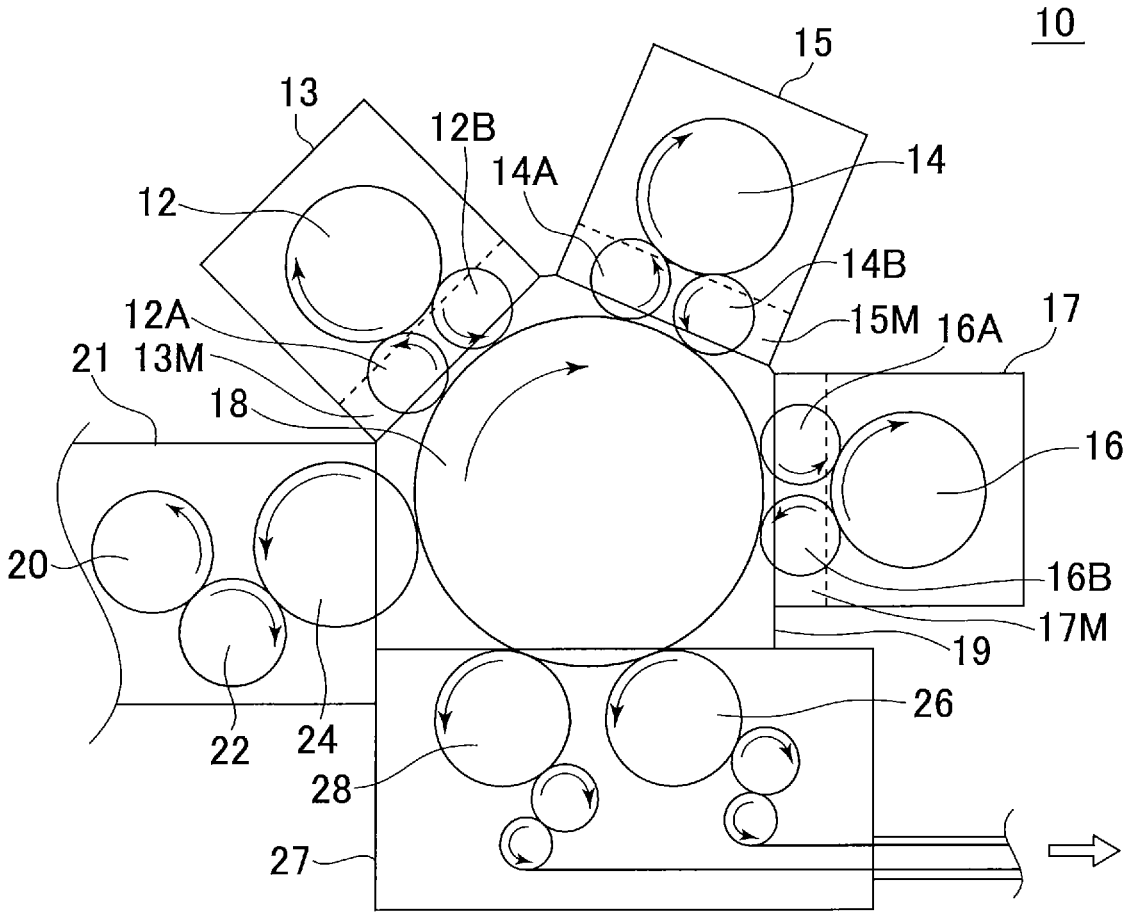
FIG. 1 is a plan view illustrating an arrangement of the filling system of the present embodiment.

Hereafter, embodiments of the present invention are described with reference to the accompanying drawings. FIG. 1 is a plan view of a filling system according to an embodiment of the present invention.

The filling system 10 of the present embodiment includes, for example, three filling machines such as a first to third filler 12, 14 and 16. The first to third filler 12, 14 and 16 are arranged around a center wheel (a conveyance wheel) 18, which conveys vessels. The first to third filler 12, 14 and 16 and the center wheel 18 are arranged inside an integrated chamber. The interior of the chamber is partitioned by walls and divided into a first to third filling chamber 13, 15 and 17 where the first to third filler 12, 14 and 16 are disposed, respectively, and a conveyance chamber 19 where the center wheel 18 is disposed.

Furthermore, in the present embodiment are rotary-type first to third inlet wheels 12A, 14A and 16A that receive empty vessels from the center wheel 18 and hand them over to the respective first to third fillers 12, 14 and 16 and rotary type first to third outlet wheels 12B, 14B and 16B that receive filled vessels from the respective first to third fillers 12, 14 and 16 and hand them over to the center wheel 18, all of which are provided, respectively, between the first to third fillers 12, 14, 16 and the center wheel 18. The areas between the first to third filling chambers 13, 15, 17 and conveyance chamber 19 are designated first to third intermediate zones (intermediate chambers) 13M, 15M and 17M, respectively. The first to third inlet wheels 12A, 14A, 16A and the first to third outlet wheels 12B, 14B, 16B are each arranged in the corresponding first to third intermediate zones 13M, 15M and 17M.

Namely, vessels can be supplied from the center wheel 18 to the first filler 12 via the first inlet wheel 12A and the vessels filled by the first filler 12 are returned to the center wheel 18 via the outlet wheel 12B. Likewise, vessels can be supplied from the center wheel 18 to the second and third fillers 14 and 16 via the respective inlet wheels 14A and 16A and the filled vessels are returned from the second and third fillers 14 and 16 to the center wheel 18 via the outlet wheels 14B and 16B.

In the present embodiment, the first, second and third fillers 12, 14 and 16 are arranged around the center wheel 18 in this order, which is also the upstream to downstream order with respect to the vessel conveyance direction. The first filler 12 may be a filler for a solid substance and the second filler 14 may be a weight filler (for non-carbonated beverage). Furthermore, the third filler 16 may be a gas filler (for carbonated and non-carbonated beverage). Empty vessels are supplied to the center wheel 18 from the upstream side of the first filler 12 via conveyance wheels 20, 22 and 24. The conveyance wheels 20, 22 and 24 are, for example, arranged inside a vessel sterilization chamber 21 and sterilized empty vessels are supplied from the vessel sterilization chamber 21 to the center wheel 18 inside a conveyance chamber 19.

In the filling system 10 of the present embodiment, either solid, liquid or gas content or a combination thereof is filled into a vessel by at least one of the first to third fillers 12, 14 and 16. The vessel, which was subjected to a filing operation at each filler, is handed over to the center wheel 18.

Further around the center wheel 18 on the downstream side of the third filler 16, a capper for capping a filled vessel may be arranged. In the present embodiment, for example, a plurality of cappers corresponding to caps having different calibers are arranged. An example shown in the figure is provided with two cappers: a first capper 26 and a second capper 28. The first and second the capper 26 and 28 are, for example, provided inside a capper chamber 27. The vessels that have been filled in the filling system 10 are delivered to either of the first or the second capper 26, 28 and further transported to a downstream processing system after capping is completed.

Next, with reference to FIG. 2, the relationship between the first to third filling chambers 13, 15, 17; the first to third intermediate zones 13M, 15M, 17M; the conveyance chamber 19; the first to third fillers 12, 14, 16; the inlet wheels 12A, 14A, 16A; the outlet wheels 12B, 14B, 16B; and the center wheel 18 of the present embodiment will be explained in detail. Note that, since the configurations are common among the first to third filling chambers 13, 15 and 17, representative examples for each of the components will be explained below.

Figure 2:
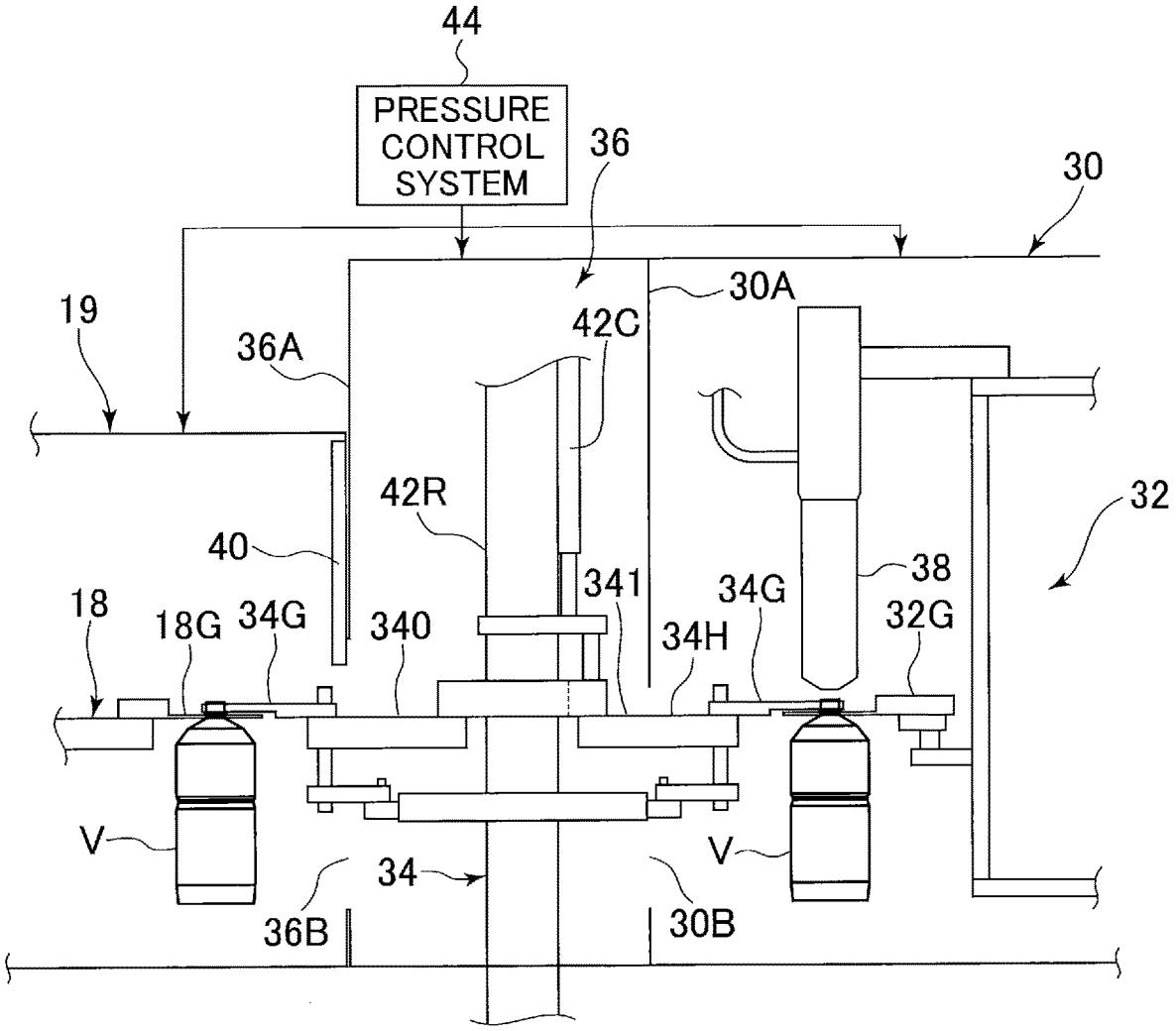
FIG. 2 is side sectional view illustrating the relationship between the filling chamber, the intermediate zone and the conveyance chamber.

FIG. 2 is a side sectional view showing the relationship between the conveyance chamber, intermediate zones (intermediate chambers) and filling chambers. In FIG. 2, the first to third filling chambers 13, 15 and 17 are represented by a filling chamber 30 and the first to third fillers 12, 14 and 16 are represented by a filler (filling machine) 32. Likewise, the inlet wheels 12A, 14A and 16A and outlet wheels 12B, 14B and 16B are represented by an inlet/outlet wheel 34, while the first to third intermediate zones (intermediate chambers) 13M, 15M and 17M are represented by an intermediate zone (intermediate chamber) 36.

As described in the figure, between the conveyance chamber 19 and the intermediate zone 36 is partitioned by a partition wall 36A and between the intermediate zone 36 and the filling chamber 30 is partitioned by a partition wall 30A. The center wheel 18 is arranged inside the conveyance chamber 19, the inlet/outlet wheel 34 inside the intermediate zone 36 and the filler 32 inside the filling chamber 30.

The center wheel 18, inlet/outlet wheel 34 and the filler 32, for example, perform neck-handle conveyance, while on the circumference of the wheel of each device multiple grippers for holding a lip or a neck of a vessel V are provided along the periphery. For example, the center wheel 18 is provided with grippers 18G and the inlet/outlet wheel is provided with grippers (vessel grasping means/vessel holding means) 34G. Likewise, the filler 32 is provided with grippers 32G.

An opening 30B is provided in the partition wall 30A, which separates the space between the intermediate zone 36 and the filling chamber 30. The grippers 34G of the inlet/outlet wheel 34 installed inside the intermediate zone 36 extend outward from inside the filling chamber 30 through the opening 30B with a rotating wheel 34H supporting the grippers 34G. Namely, the grippers 34G of the inlet/outlet wheel 34 hand over the vessels V to the grippers 32G of the filler 32 inside the filling chamber 30. Note that, the size and the shape of the opening 30B are preferably as small as possible unless it obstructs the passage of the grippers 34G, the rotary wheel 34H and the vessels V between the intermediate zone 36 and the filling chamber 30.

Inside the filling chamber 30, above the grippers 32G of the filler 32, filling heads (filling means) 38 are respectively provided along the periphery of the wheel of the filler 32 at positions corresponding to each of the grippers 32G. While the wheel is being rotated, predetermined content is supplied from the filling heads 38 to the empty vessels V, which are held by the grippers 32G.

Furthermore, an opening 36B is provided in the partition wall 36A, which separates between the intermediate zone 36 and the conveyance chamber 19. The grippers 34G of the inlet/outlet wheel 34 extend outward from inside the conveyance chamber 19 through the opening 36B with the rotating wheel 34H supporting the grippers 34G. Namely, the grippers 34G of the inlet/outlet wheel 34 hand over the vessels V to the grippers 18G of the center wheel 18 inside the conveyance chamber 19. Note that, the opening 36B has a rectangular shape and its size is determined so that it does not obstruct the passage of the grippers 34G, the rotary wheel 34H and the vessels V between the intermediate zone 36 and the conveyance chamber 19.

Near the opening 36B, a shutter (opening/closing door, open/close means) 40 is provided that can close the opening 36B. The shutter 40, for example, is driven by a rack and pinion mechanism, as explained later, and the mechanism is driven by a motor 40M provided outside the chamber.

Further, in order to close the opening 36B with the shutter 40, the rotary wheel 34H of the inlet/outlet wheel 34, which extends out through the opening 36B, and the grippers 34G attached thereto should be removed from the opening 36B.

In the present embodiment, as described later, a movable section 341 corresponding to a part of the arcuate section of the rotary wheel 34H together with the grippers 34G attached thereto can be raised and lowered either above or below the vertical position of a fixed section 340 configuring an arcuate section of the rotary wheel 34H not part of the movable section 341. Inside the intermediate zone 36, the movable section 341 is shifted relatively higher or lower than the fixed section 340 to be rotatable about the rotational axis of the rotary wheel 34H, thereby making the movable section 341 rotationally movable to a retracted position located above or below the fixed section 340.

In the present embodiment, the movable section 341 is raised or lowered by a lift cylinder 42C provided on the inlet/outlet wheel 34 and rotated about the rotational axis of the inlet/outlet wheel 34 via a rotary mechanism 42R. Note that, in FIG. 2, an example in which the movable section 341 is lifted upward with respect to the fixed section 340 is illustrated.

When the opening 36B is closed by shutter 40, the movable section 341 is moved to the retracted position and then the rotary wheel 34H is rotated so that the portion where the retracted movable section 341 was disposed before the retraction is positioned at the opening 36B. Thereby, the rotary wheel 34H is retracted from the opening 36B so that the shutter 40, which closes the opening 36B, and the rotary wheel 34H do not interfere with one another.

Furthermore, the filling system 10 includes a pressure control system (pressure control means) 44. The pressure control system 44 controls the air supply whereby the pressure increases in order from the conveyance chamber 19 to the intermediate zone 36 to the filling chamber 30 (air pressure in conveyance chamber 19<intermediate zone 36<filling chamber 30) when the filler 32 is in operation, in other words, when the vessels are transferred among the center wheel 18, the inlet/outlet wheel 34 and the filler 32. On the other hand, when other fillers instead of the filler 32 are in operation and when the filler 32 is being washed (a second operation mode), i.e., when the movable section 341 is moved to the retracted position and the opening is closed by the shutter 40, the air supply for each of the sections 36, 30 and 19 is controlled so that the pressure increases in order from the intermediate zone 36 to the filling chamber 30 to the conveyance chamber 19 (air pressure in intermediate zone 36<filling chamber 30<conveyance chamber 19).

Figure 3A:
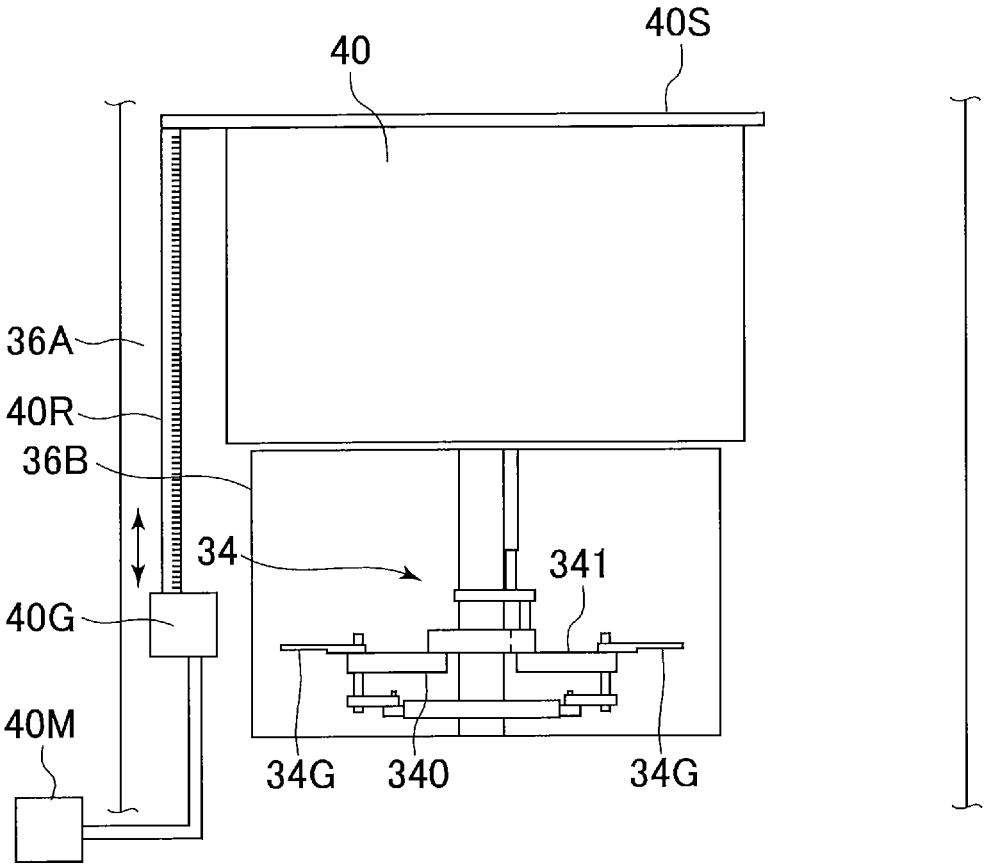
FIG. 3A illustrates the intermediate zone provided with the inlet/outlet wheel from the point of view of the conveyance chamber as seen through the opening.
Figure 3B:
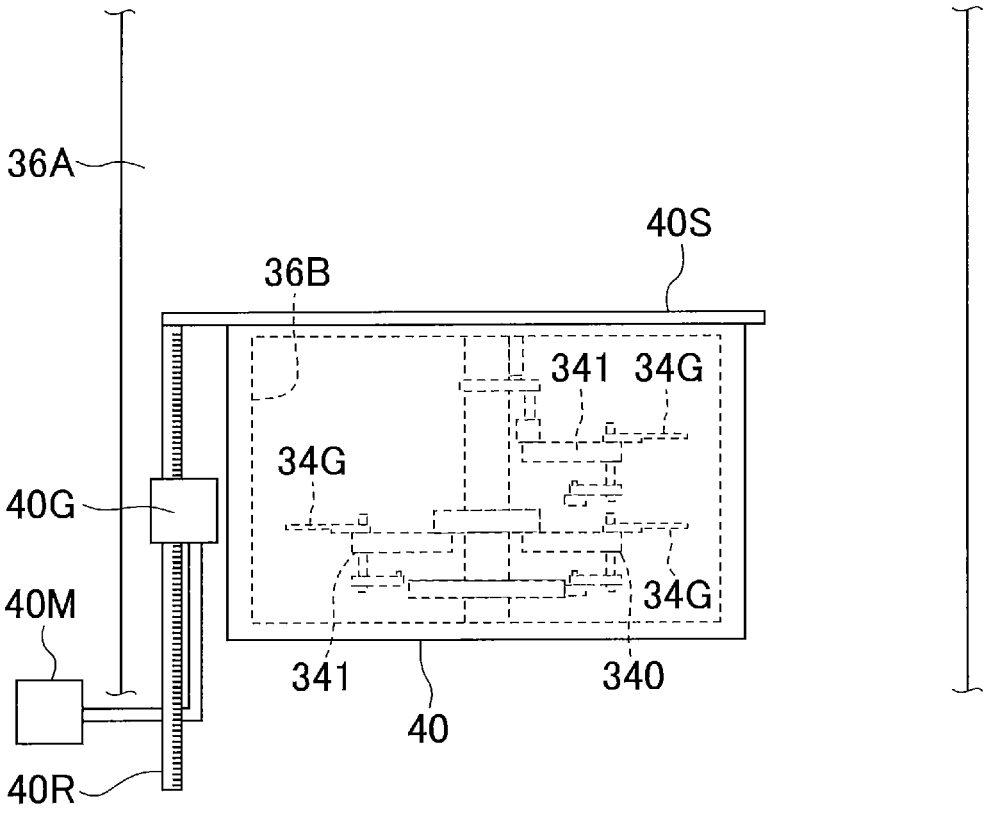
FIG. 3B also illustrates the intermediate zone provided with the inlet/outlet wheel from the point of view of the conveyance chamber as seen through the opening.

FIGS. 3A and 3B illustrate the intermediate zone 36, where the inlet/outlet wheel 34 is installed, from the point of view of the conveyance chamber 19 through the opening 36B. FIG. 3A illustrates a state of the first operation mode, in which the shutter 40 is opened, the movable section 341 forms part of the rotary wheel 34H at the position before the retraction is performed, and the vessels are transferred between the grippers 34 and the center wheel 18. FIG. 3B illustrates a state of the second operation mode, in other words when the movable section 341 is moved to the retracted position, the grippers 34G are not in operation (the vessels are not received from the center wheel 18) and the shutter 40 is closed. Note that, switching between the first operation mode and the second operation mode in the filling system 10 is controlled by a controller that is not shown.

As described in FIGS. 3A and 3B, the upper side of the shutter 40 is, for example, held by the support member 40S, which is supported by a rack 40R. The rack 40R engages with a pinion driven by a motor 40M, inside a gearbox 40G, so that it is raised and lowered by the rotation of the motor 40M. Thereby, the shutter 40 can be raised and lowered to open and close the opening 36B.

Figure 4A:
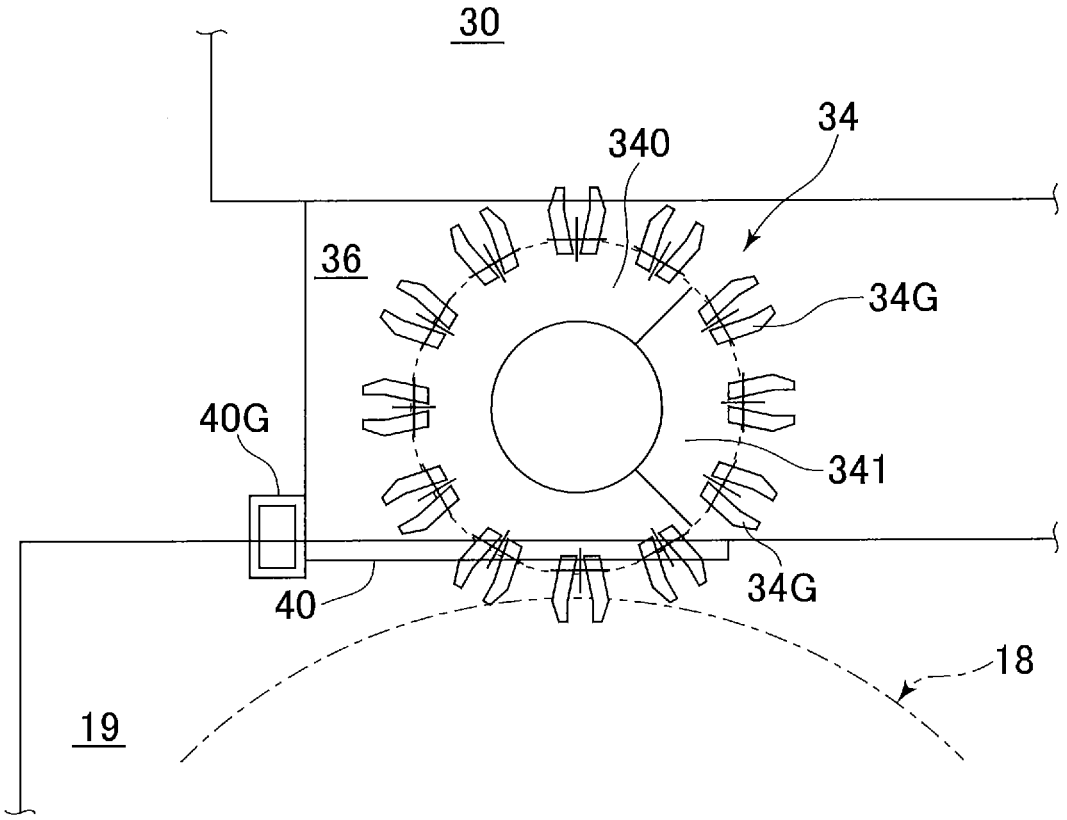
FIG. 4A is a plan view illustrating an arrangement of the filling chamber, the intermediate zone and the inlet/outlet wheel inside the conveyance chamber.
Figure 4B:
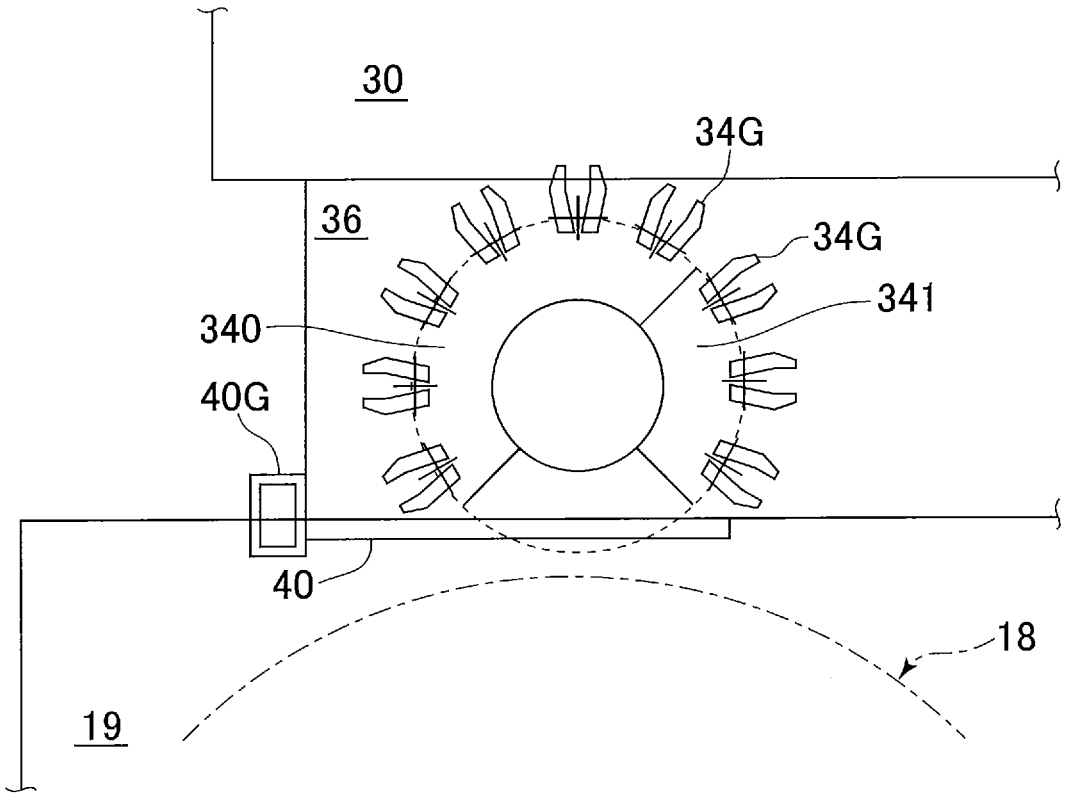
FIG. 4B is a plan view illustrating an arrangement of the filling chamber, the intermediate zone and the inlet/outlet wheel inside the conveyance chamber.

FIGS. 4A and 4B are plan views illustrating an arrangement of the filling chamber 30, the intermediate zone 36 and the inlet/outlet wheel 34 inside the conveyance chamber 19. FIG. 4A illustrates when the system is operated in the first operation mode in which the filler 32 of the filling chamber 30 is used. FIG. 4B illustrates when the system is operated in the second operation mode, in which the filler 32 of the filling chamber 30 is inactive and the center wheel 18 and the other fillers are active while the movable section 341 of the inlet/outlet wheel 34 is retracted, the shutter 40 is closed, and further, the filler 32 is being washed.

As illustrated in FIG. 4A, the movable section 341 together with the fixed section 340 forms the circular rotary wheel 34H of the inlet/outlet wheel 34, when the filler 32 is being used, a part of the rotary wheel 34H extends out to the conveyance chamber 19 through the opening 36B, and the gripper 34G provided on the periphery of the rotary wheel 34H protrudes out to a position where it can hand over a vessel to the gripper of the conveyance wheel 18 in the conveyance chamber 19. Note that, in this state, the rotations of the conveyance wheel 18, the inlet/outlet wheel 34 and the filler 32 are obviously synchronized to enable the hand over between each of the grippers.

In the conditions of FIG. 4B, the operation of the filler 32 and the inlet/outlet wheel 34 is suspended and the conveyance wheel 18 conveys vessels to inlet/outlet wheels of the other fillers. As illustrated in FIG. 4B, the movable section 341 is moved to the retracted position, which overlaps above the fixed section 340, an arcuate portion of the rotary wheel 34, in which the movable section 341 is displaced, faces the opening 36B and the shutter 40 is closed via the motor 40M drive.

In the above-mentioned configuration, the filling system 10 of the present embodiment is, for example, operated as described below. For example, a solid substance is filled into the vessel V from the first filler 12. When liquid is filled from the second filler 14, the first and second fillers 12 and 14 are operated and the first and second inlet wheels 12A, 14A and the first and second outlet wheels 12B, 14B are operated in the state shown in FIG. 3A and FIG. 4A with the shutter 40 opened. Note that, the third filler 16 is not driven in this situation.

On the other hand, when only the second filler 14 for filling liquid and the third filler 16 for filling gas are used and the first filler 12 for filling a solid substance is not used, the operation of the first filler 12, the first inlet wheel 12A and the first outlet wheel 12B is suspended. The movable sections 341 of the inlet wheel 12A and the outlet wheel 12B are moved to the retracted positions, and then, two openings 36B provided in the partition walls 36A of the first intermediate zone 13M corresponding to the first inlet wheel 12A and the first outlet wheel 12B are closed. Thereby, the filling chamber 13 provided with the first filler 12 and the first intermediate zone 13M are separated from the conveyance chamber 19 provided with the center wheel 18, so that the first filler 12 can be washed while the vessels are conveyed to the second and third fillers 14, 16 by the operation of the center wheel 18.

As described above, according to the present embodiment, the filling system can wash an inactive filling machine while performing a filling operation with another (other) filling machine(s) and improve the efficiency of the cleaning operation for the filling machine by automatically moving the grippers to a position that does not interfere with the shutter.

Figure 5:
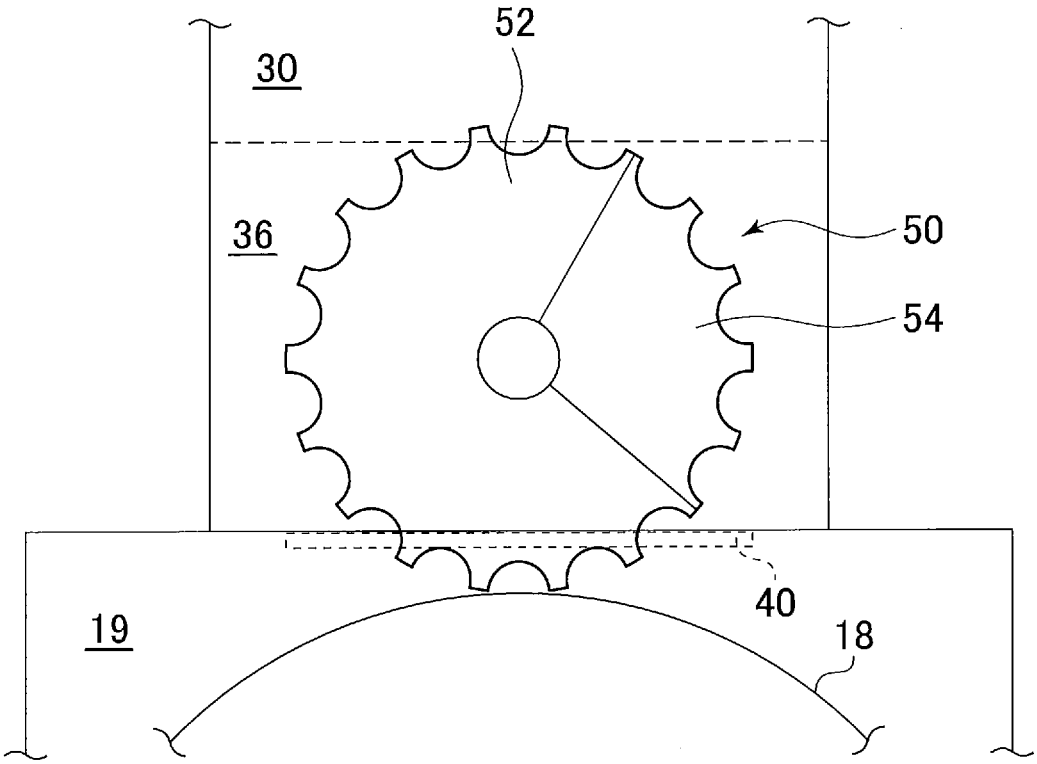
FIG. 5 is a plan view illustrating an arrangement when a star wheel is adopted for the inlet/outlet wheel.

In the present embodiment, a gripper-type conveyance wheel is adopted for the inlet/outlet wheel; however, a star wheel may also be adopted as illustrated in FIG. 5, which is a plan view corresponding to FIG. 4A. Similar to the inlet/outlet wheel 34 with the grippers 34G, an inlet/outlet star wheel includes a fixed section 52 and a movable section 54. When closing the shutter 40, the movable section 54 is moved to the retracted position.

EXPLANATION OF REFERENCES

10 filling system
12 first filler
12A first inlet wheel
12B first outlet wheel
13 first filling chamber
13M first intermediate zone
14 second filler
14A second inlet wheel
14B second outlet wheel
15 second filling chamber
15M second intermediate zone
16 third filler
16A third inlet wheel
16B third outlet wheel
17 third filling chamber
17M third intermediate zone
18 center wheel (conveyance wheel)
18G gripper
19 conveyance chamber
30 filling chamber
32 filler
32G gripper
34 inlet/outlet wheel
34G gripper
34H rotary wheel
36 intermediate zone
36A partition wall
36B opening
40 shutter
42C lift cylinder
42R rotary mechanism
44 presser control system
340 fixed section
341 movable section
V vessel

The invention claimed is:

1. A filling system comprising:

a conveyance chamber in which an aseptic condition is maintained and in which a conveyor for conveying vessels is housed inside;

a filling chamber that is connected to the conveyance chamber and where a rotary-type filling machine that comprises a plurality of filling dispensers is housed inside;

a rotary-type vessel handler that hands over the vessels from the conveyor to the filling machine;

an opening that is provided between the two chambers and that allows conveyance of the vessels via the vessel handler; and a closure for closing the opening; wherein the vessel handler comprises a vessel holder that can retain the vessels; and a part of the vessel holder can be raised and lowered with respect to a rotational axis of the vessel handler; and when the closure closes the opening, a part of the vessel holder is raised or lowered by a predetermined amount relative to another vessel holder, after which the vessel handler is rotated by a predetermined amount to a position where it does not interfere with the closure.

* * * * *